US008712312B2

(12) United States Patent
Lee et al.

(10) Patent No.: US 8,712,312 B2
(45) Date of Patent: Apr. 29, 2014

(54) COVER OPENING AND CLOSING UNIT AND IMAGE FORMING APPARATUS INCLUDING THE SAME

(75) Inventors: Jae-wuk Lee, Suwon-si (KR); Je-won Jung, Seoul (KR)

(73) Assignee: Samsung Electronics Co., Ltd., Suwon (KR)

( * ) Notice: Subject to any disclaimer, the term of this patent is extended or adjusted under 35 U.S.C. 154(b) by 198 days.

(21) Appl. No.: 13/420,746

(22) Filed: Mar. 15, 2012

(65) Prior Publication Data

US 2013/0011174 A1 Jan. 10, 2013

(30) Foreign Application Priority Data

Jul. 5, 2011 (KR) ..... 10-2011-0066443
Oct. 25, 2011 (KR) ..... 10-2011-0109434

(51) Int. Cl.

| | |
|---|---|
| ***G03G 15/00*** | (2006.01) |
| ***G03G 21/00*** | (2006.01) |
| ***B65H 3/44*** | (2006.01) |
| ***B41J 11/60*** | (2006.01) |
| ***B65H 11/00*** | (2006.01) |

(52) U.S. Cl.

USPC ..... 399/392; 399/124; 271/9.09; 400/693

(58) Field of Classification Search

CPC ..... G03G 21/1633; G03G 15/6514; G03G 2215/00392; G03G 2221/169; B65H 2405/1117; B65H 2405/324; B65H 2407/21; B65H 2402/441; B65H 11/00; B41J 11/006; B41J 11/38

USPC ..... 399/124, 392; 271/9.09, 162; 400/693, 400/691

See application file for complete search history.

(56) References Cited

U.S. PATENT DOCUMENTS

| | | | | |
|---|---|---|---|---|
| 2004/0062579 | A1 | 4/2004 | Iwago et al. | 399/367 |
| 2008/0185943 | A1 | 8/2008 | Hirose et al. | 312/237 |
| 2011/0001284 | A1* | 1/2011 | Ohtsuki | 271/162 |
| 2011/0135368 | A1* | 6/2011 | Yamamoto | 400/578 |

FOREIGN PATENT DOCUMENTS

| | | | | |
|---|---|---|---|---|
| EP | 1939695 | | 7/2008 | |
| JP | 09190029 | * | 7/1997 | G03G 15/00 |
| JP | 2006-341987 | | 12/2006 | |
| JP | 2007-70044 | | 3/2007 | |
| JP | 2007-293196 | | 11/2007 | |
| JP | 2010-164773 | | 7/2010 | |

OTHER PUBLICATIONS

Extended European Search Report issued Nov. 13, 2012 in corresponding European Patent Application No. 12159174.7.

International Search Report issued Sep. 24, 2012 in corresponding International Patent Application No. PCT/KR2012/001355.

* cited by examiner

*Primary Examiner* — Daniel J Colilla
*Assistant Examiner* — Blake A Tankersley
(74) *Attorney, Agent, or Firm* — Staas & Halsey LLP

(57) ABSTRACT

A cover opening and closing unit includes a cover installed to be opened from and close a main body and a manual paper feed tray that is rotatably installed on the cover. The cover is connected to the main body by a link element and a connection link is connected to the link element and the manual paper feed tray so that, when the cover is opened from the main body when the manual paper feed tray is in an opened state with respect to the cover, an open angle of the manual paper feed tray with respect to a vertical direction is maintained within 90 degrees.

16 Claims, 6 Drawing Sheets

COVER OPENING AND CLOSING UNIT AND IMAGE FORMING APPARATUS INCLUDING THE SAME

CROSS-REFERENCE TO RELATED PATENT APPLICATION

This application claims the benefit of Korean Patent Applications No. 10-2011-0066443, filed on Jul. 5, 2011, and No. 10-2011-0109434, filed on Oct. 25, 2011, in the Korean Intellectual Property Office, the disclosure of which is incorporated herein in its entirety by reference.

BACKGROUND OF THE INVENTION

1. Field

Example embodiments of the following description relate to a cover opening and closing unit and an image forming apparatus including the same, and more particularly, to a cover opening and closing unit in which, when a cover is opened when a manual paper feed tray is opened, an angle of the manual paper feed tray with respect to the cover is adjusted so that sheets of paper do not fall, and an image forming apparatus including the same.

2. Description of the Related Art

In general, electrophotographic image forming apparatuses form a desired image by forming a desired electrostatic latent image on a photosensitive medium by using a light exposure unit, developing the electrostatic latent image as a toner image by using powder-type toner, transferring the toner image onto a recording medium by using a transferring medium, and fixing the toner image thereon.

Image forming apparatuses may include paper feed cassettes installed below a printing unit to be opened and closed and store sheets of paper and manual paper feed units installed at a side of the printing unit to be opened and closed for a sheet of paper to be manually fed by users. The manual paper feed unit may be rotatably attached to a cover. When the cover is opened, the manual paper feed unit may also be opened. The cover may be installed to easily remove jammed sheets of paper during printing or to open and close the image forming apparatus in order to replace parts constituting the printing unit.

When the manual paper feed tray is opened, a sheet of paper may be loaded on the manual paper feed tray. However, when the cover is opened when the manual paper feed tray is opened, the manual paper feed tray is moved together with the cover, and thus the sheet of paper loaded on the manual paper feed tray falls.

To address this problem, Japanese Patent Laid-Open Publication Nos. 2007-70044 and 2006-341987 discloses a method of preventing sheets of paper loaded on a manual paper feed tray from falling even though the manual paper feed tray is tilted, by attaching to the manual paper feed tray a separate device capable of fixing sheets of paper to the manual paper feed tray.

In addition, a structure in which a separate element such as wires is directly connected to a main body frame, and thus a manual paper feed tray is not tilted is disclosed in Japanese Patent Laid-Open Publication Nos. 2007-70044 and 2006-341987.

However, these methods incur high costs in raw materials and have complicated structures. In other words, in a case of a structure in which a manual paper feed tray is connected to a cover link, a plurality of links are used to maintain an angle of the manual paper feed tray with respect to a cover, resulting in complicated structures. A structure in which a manual paper feed tray is moved further downward and then upward when the cover is opened has a limitation that an angle at which the manual paper feed tray is opened is in the range of 70 degrees or less.

SUMMARY

The foregoing and/or other aspects are achieved by providing a cover opening and closing unit in which, when a cover is opened, a manual paper feed tray may be connected to the cover in a simplified structure by using an existing link for supporting the cover and an angle of the manual paper feed tray may be adjusted to correspond to an angle at which the cover is opened, thereby preventing sheets of paper from falling.

The foregoing and/or other aspects are also achieved by providing an image forming apparatus including the same.

According to an aspect, there may be provided a cover opening and closing unit which may include: a cover installed to be opened from and close a main body; a manual paper feed tray on which sheets of paper are loaded installed on the cover to rotate to a closed position and an opened position having an open angle with respect to a vertical direction and; a link element connecting the cover to the main body; and a connection link having a first end connected to the link element and a second end connected to a guide rail installed on a side of the manual paper feed tray, the connection link interacting with a rotation of the link element so that, when the cover is opened when the manual paper feed tray is positioned in the opened position, the open angle of the manual paper feed tray is maintained within 90 degrees with respect to a vertical direction.

The link element may include a plurality of main links that are rotatably connected to one another and a plurality of springs that are respectively installed in connection portions between the plurality of main links to apply an elastic force in a direction in which the plurality of main links are unfolded from each other.

A cover-side main link connected to the cover, among the plurality of main links, may include a protrusion to which the first end of the connection link is rotatably connected.

A guide protrusion may be installed at the second end of the connection link to be inserted into the guide rail to slide along the guide rail.

The open angle may be 90 degrees or less with respect to the vertical direction regardless of whether the cover is opened or closed.

The cover may be opened at an angle of 50 degrees or less with respect to the main body.

According to another aspect, there may be provided an image forming apparatus which may include: at least one developing unit for developing an electrostatic latent image; a fixing unit for fixing a toner image developed by the developing unit on paper; and the cover opening and closing unit described above.

According to another aspect, there may be provided a cover opening and closing unit which may include: a cover installed to be opened from and close a main body; a manual paper feed tray on which sheets of paper are loaded, installed on the cover to rotate to a closed position and an opened position, and comprising a guide rail; a link element connecting the cover to the main body and including a plurality of links that rotate with respect to each other in a direction in which the plurality of links are unfolded from each other or folded with each other when the cover is opened or closed; and a connection link having a first end that is rotatably connected to one of the plurality of links and a second end that is slidably connected to the guide rail, the connection link interacting with the rotation of the plurality of links so that, when the cover is opened when the manual paper feed tray is positioned in the opened position, an open angle of the manual paper feed tray with respect to a vertical direction is maintained within 90 degrees.

The cover opening and closing unit may further include a plurality of springs that apply an elastic force in a direction in which the plurality of links are unfolded from each other.

When the cover is opened when the manual paper feed tray is positioned in the opened position, the manual paper feed tray may rotate toward the cover.

One of the plurality of links may include a connection part to which the first end of the connection link is rotatably connected, wherein, when the cover is opened, the plurality of links are unfolded from each other and the connection part is moved away from the cover.

BRIEF DESCRIPTION OF THE DRAWINGS

These and/or other aspects and advantages will become apparent and more readily appreciated from the following description of the example embodiments, taken in conjunction with the accompanying drawings of which.

DETAILED DESCRIPTION

Figure 1:
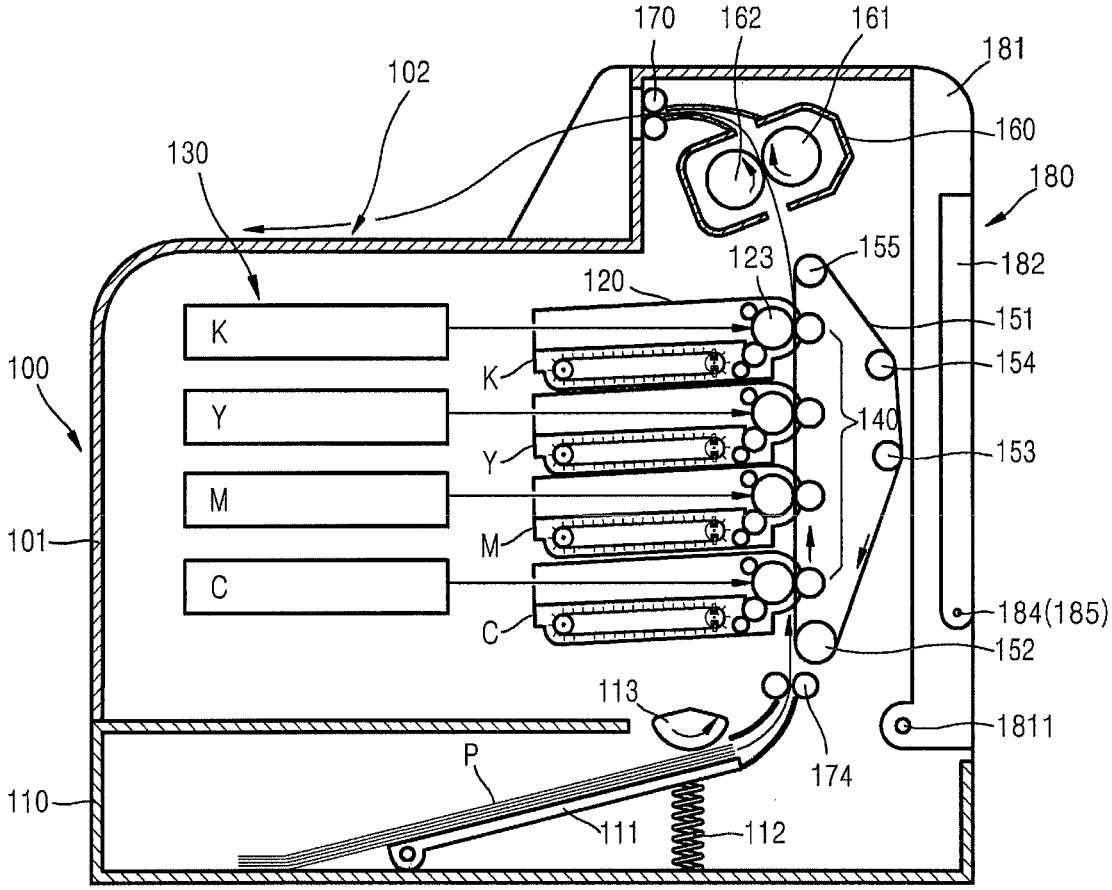
FIG. 1 is a schematic side view illustrating a structure of an image forming apparatus including a cover opening and closing unit according to an embodiment.

Reference will now be made in detail to example embodiments, examples of which are illustrated in the accompanying drawings, wherein like reference numerals refer to the like elements throughout. Example embodiments are described below to explain the present disclosure by referring to the figures.

FIG. 1 is a schematic side view illustrating a structure of an image forming apparatus 100 including a cover opening and closing unit according to an embodiment.

Referring to FIG. 1, the image forming apparatus 100, which may print an image on paper in an electrophotographic process, may include a cassette 110, in which sheets of paper P may be loaded, at a lower portion of and detachably attached to a main body 101. The cassette 110 may be elastically biased upward by a spring 112 and may include a paper support 111 on which the sheets of paper P may be loaded. A pickup roller 113 may be installed at an upper portion of the cassette 110 to pick up a sheet of paper P by rotating.

The image forming apparatus 100 may include a development unit 120, a light exposure unit 130, transfer rollers 140, a transfer belt 151, a fixing unit 160, and a paper delivering unit 170.

The development unit 120 may store toner and provide the toner to an electrostatic latent image corresponding to a printing signal, thereby developing the electrostatic latent image as a toner image. The development unit 120 may include a plurality of developing cartridges 120C, 120M, 120Y, and 120K that may respectively store cyan (C) toner, magenta (M) toner, yellow (Y) toner, and black (K) toner to realize colored images.

The light exposure unit 130 may radiate light to a photosensitive drum 123 to form an electrostatic latent image corresponding to a printing signal, and may include a plurality of light exposure units 130C, 130M, 130Y, and 130K that respectively may correspond to the plurality of developing cartridges 120C, 120M, 120Y, and 120K. Light radiated from the plurality of light exposure units 130C, 130M, 130Y, and 130K may transmit through openings formed in the development unit 120, thereby being radiated onto the photosensitive drum 123.

The transfer belt 151 may be supported by a plurality of rollers 152, 153, 154 and 155, and, by rotating in a loop form, the transfer belt 151 may transfer a sheet of paper P that is picked from the cassette 110 and then transferred by transfer rollers 174 so that the sheet of paper P sequentially passes by the developing cartridges 120C, 120M, 120Y, and 120K.

The transfer rollers 140 may be installed inside the transfer belt 151 to respectively correspond to the developing cartridges 120C, 120M, 120Y, and 120K with the transfer belt 151 therebetween and may transfer a toner image formed on a photosensitive drum 123 onto the sheet of paper P transferred by the transfer belt 151.

The fixing unit 160 may fix the toner image on the sheet of paper P and may include a heating roller 161 that heats the toner image and a pressing roller 162 that contacts the heating roller 161 and presses the sheet of paper P passing through between the heating roller 161 and the pressing roller 162 against the heating roller 161.

The paper delivering unit 170 may deliver the sheet of paper P with the toner image fixed thereon to the outside of the image forming apparatus after the sheet of paper P passes through the fixing unit 160. The paper delivering unit 170 may include a pair of rollers that are installed to face each other and may deliver the sheet of paper P with the toner image fixed thereon to the outside. The sheet of paper P may be delivered by the paper delivering unit 170 and stacked on a paper delivery plate 102.

Figure 2:
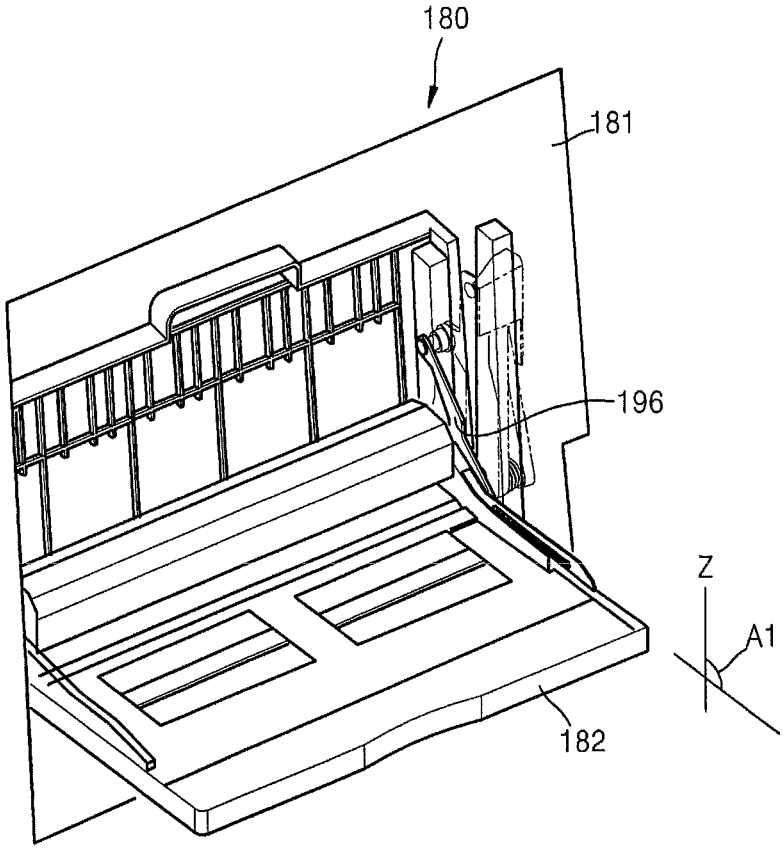
FIG. 2 is a partial perspective view illustrating when a manual paper feed tray of the cover opening and closing unit of FIG. 1 is opened from a cover of the cover opening and closing unit, according to an embodiment.
Figure 3:
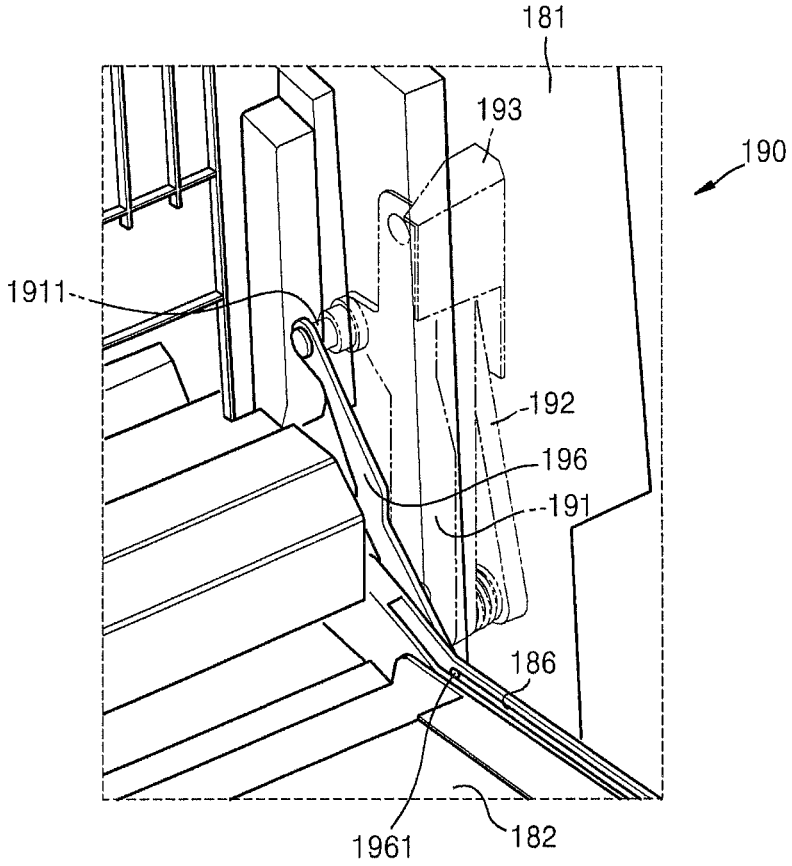
FIG. 3 is a partial exploded view of the cover opening and closing unit of FIG. 2, according to an embodiment.
Figure 4:
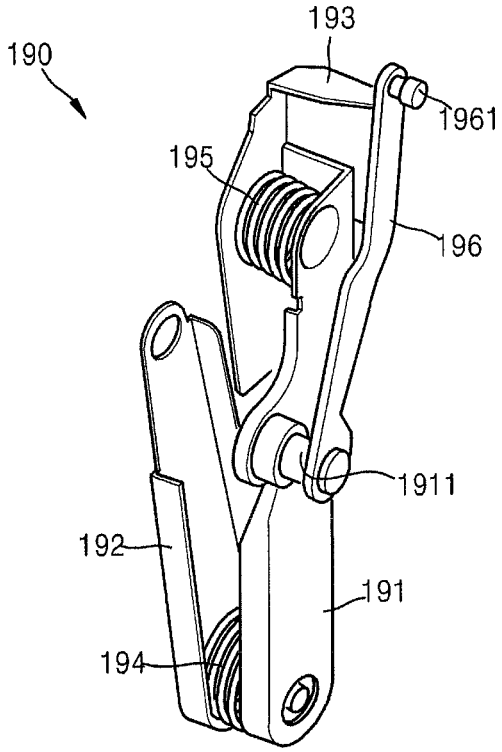
FIG. 4 is a partial perspective view of a link element illustrated in FIG. 3, according to an embodiment.
Figure 5:
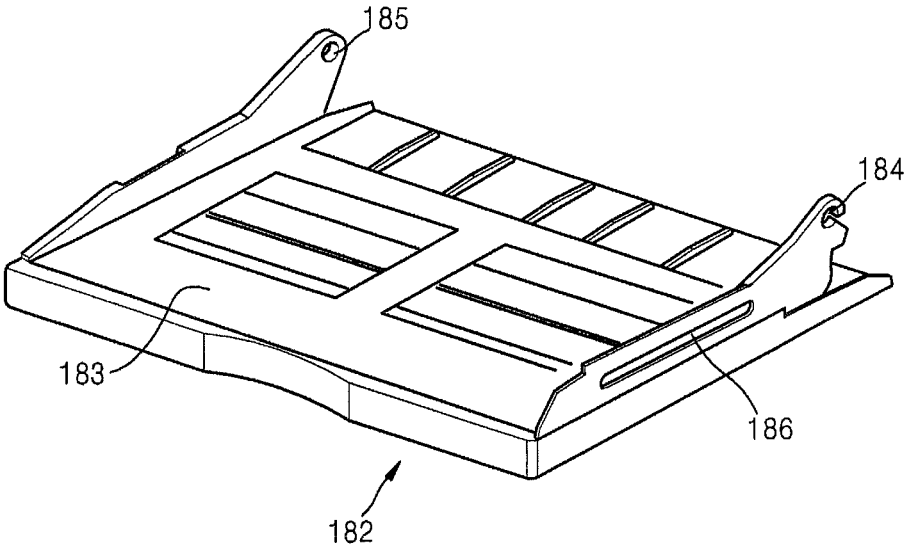
FIG. 5 is a partial perspective view of the manual paper feed tray of FIG. 2, according to an embodiment.

FIG. 2 is a partial perspective view illustrating when a manual paper feed tray 182 of the cover opening and closing unit 180 of FIG. 1 is opened from a cover 181 of the cover opening and closing unit 180, according to an embodiment. FIG. 3 is a partial exploded view of the cover opening and closing unit 180 of FIG. 2, according to an embodiment. FIG. 4 is a partial perspective view of a link element 190 illustrated in FIG. 3, according to an embodiment. FIG. 5 is a partial perspective view of the manual paper feed tray 182 of FIG. 2, according to an embodiment.

Referring to FIGS. 1 through 5, the cover opening and closing unit 180 may be installed at a side of the main body 101.

The cover opening and closing unit 180 may include the cover 181, the manual paper feed tray 182, the link element 190, and a connection link 196. The cover 181 may be rotatably installed on the main body 101 so as to be opened from and close a part of the main body 101. For example, the cover 181 may be combined to the main body 101 so as to rotate with respect to a hinge part 1811. The manual paper feed tray 182 may be hinge-combined to the cover 181 to rotate to a closed position (refer to FIG. 1) and an opened position (refer to FIG. 2) having a first open angle (A1 in FIG. 2) with respect to a vertical direction (Z axis). The link element 190 may connect the cover 181 to the main body 101. The link element 190 may include a plurality of links that rotate with respect to each other when the cover 181 is opened from and closes the main body 101. The connection link 196 may connect the manual paper feed tray 182 to the link element 190, i.e., any one of the plurality of links. When the cover 181 is opened from the main body 101 when the manual paper feed tray 182 is positioned in an opened position, the connection link 196 may interact with a rotation of the link element 190 and maintain a second open angle (A2 in FIG. 6) of the manual paper feed tray 182 with respect to a vertical direction (Z axis) within an acute angle range, i.e., within 90 degrees.

Referring to FIG. 5, the manual paper feed tray 182 may include a paper support 183 on which paper is loaded, hinge holes 184 and 185 that are hinge-combined to the cover 181, and a guide rail 186 located on an side of the paper support 183.

Referring to FIGS. 3 and 4, the link element 190 may be installed on a side of the cover 101. The link element 190 may include a cover-side main link 191, a main body-side main link 192, and a cover fixing link 193. A first end of the main body-side main link 192 may be rotatably connected to the cover-side main link 191 and a second end of the main body-side main link 192 may be rotatably connected to the main body 101. A first end of the cover fixing link 193 may be rotatably connected to the cover-side main link 191 and a second end of the cover fixing link 193 may be fixed on the cover 181 by, for example, a screw (not shown). The link element 190 may further include a first spring 194. The first spring 194 may apply an elastic force so that the main body-side main link 192 and the cover-side main link 191 rotate with respect to each other in a direction in which the main body-side main link 192 and the cover-side main link 191 are unfolded from each other. For example, the first spring 194 may be a torsion spring that is installed in a connection portion between the cover-side main link 191 and the main body-side main link 192. The link member 190 may further include a second spring 195. The second spring 195 may apply an elastic force in a direction in which the cover-side main link 191 and the cover fixing link 193 are unfolded from each other. For example, the second spring 195 may be a torsion spring that is installed in a connection portion between the cover-side main link 191 and the cover fixing link 193.

The connection link 196 may be connected to the cover-side main link 191 and the guide rail 186 of the manual paper feed tray 182. For this connection, the cover-side main link 191 may include a connection part to which a first end of the connection link 196 may be rotatably connected. For example, the connection part may include a protrusion 1911 protruding from the cover-side main link 191. A second end of the connection link 196 may include a guide protrusion 1961 that may be inserted into the guide rail 186 of the manual paper feed tray 182 to slide along the guide rail 186. As the guide protrusion 1961 slides along the guide rail 186, the manual paper feed tray 182 may rotate to a closed position and an opened position with respect to the cover 181.

Figure 6:
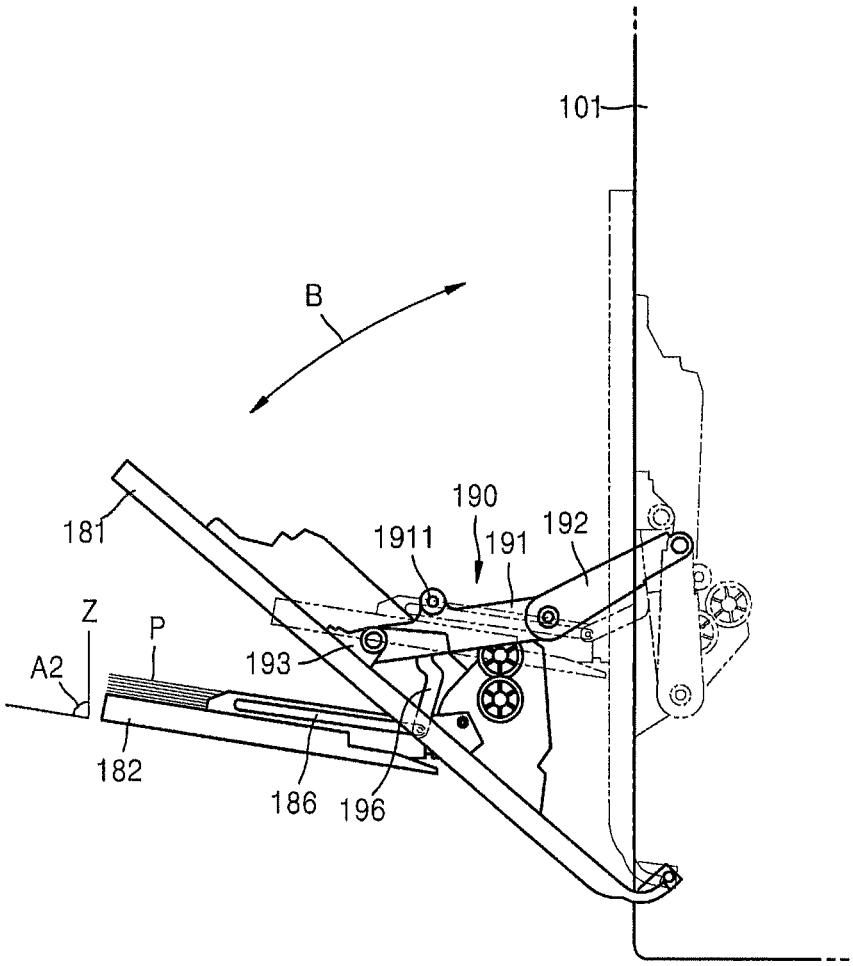
FIG. 6 is a side view an operation of a cover opening and closing unit according to an embodiment.

FIG. 6 is a side view illustrating an operation of a cover opening and closing unit according to an embodiment.

Referring to FIG. 6, a view represented by a dashed line illustrates, as illustrated in FIG. 3, when the cover 181 is attached to the main body 101 and the manual paper feed tray 182 is positioned in an opened position. When the cover 181 is in a closed state, the cover-side main link 191 and the main body-side main link 192 of the link element 190 may be folded with each other as illustrated by dotted lines in FIGS. 3 and 6. In this state, a guide protrusion 1961 that is arranged at an end of the connection link 196 may contact an end of the guide rail 186 of the manual paper feed tray 182, and thus the manual paper feed tray 182 may no longer rotate downward, and the first open angle A1 of the manual paper feed tray 182 with respect to a vertical direction (Z axis) may be maintained within 90 degrees. Therefore, sheets of paper P loaded on the manual paper feed tray 182 may not fall.

Referring to a view of FIG. 6 represented by a continuous line, when the cover 181 is opened from the main body 101, the cover-side main link 191 and the main body-side main link 192 of the link element 190 may be unfolded from each other. In this regard, the cover-side main link 191 may be moved more upward than the original position. In other words, when the cover 181 is in a closed state, the cover-side main link 191 and the main body-side main link 192 may be folded with each other and thus the protrusion 1911 may be positioned close to the cover 181. On the other hand, when the cover 181 is opened, the cover-side main link 191 and the main body-side main link 192 may be unfolded from each other and thus the protrusion 1911 may be positioned away from the cover 181. When the connection link 196 is connected to the protrusion 1911, the connection link 196 may be pulled toward the cover 181. The guide protrusion 1961 of the connection link 196 may contact the guide rail 186 of the manual paper feed tray 182 and thus, when the cover 181 is opened, the manual paper feed tray 182 may be pulled by the connection link 196 to rotate toward the cover 181. Thus, although the cover 181 is opened, the downward rotation of the manual paper feed tray 182 may be limited. Accordingly, the second open angle A2 of the manual paper feed tray 182 may be maintained within 90° with respect to a vertical direction (Z axis) and sheets of paper P loaded on the manual paper feed tray 182 may not fall.

An angle at which the cover 181 is opened with respect to the main body 101 may be determined by a degree to which an access to the inside of the main body 101 is possible through an opened space between the cover 181 and the main body 101. For example, the angle may be set to be within about 50 degrees. The first and second open angles A1 and A2 of the manual paper feed tray 182 may be within 90 degrees, for example, 85±3 degrees.

Although example embodiments have been shown and described, it would be appreciated by those skilled in the art that changes may be made in these example embodiments without departing from the principles and spirit of the disclosure. For example, the image forming apparatus may be applied not only to an electrophotographic image forming apparatus but also to other image forming apparatuses, and the electrophotographic image forming apparatus may be used for color printing or black and white printing. Thus, the spirit and scope of the disclosure is defined in the claims and their equivalents.

What is claimed is:

1. A cover opening and closing unit comprising:

a cover installed to be opened and closed from a main body;

a manual paper feed tray on which sheets of paper are loaded, the manual paper feed tray being installed on the cover to rotate to a closed position and an opened position, said opened position having an open angle with respect to a vertical direction;

a link element connecting the cover to the main body; and a connection link having a first end rotatably connected to the link element and a second end slidably connected to a guide rail installed on a side of the manual paper feed tray, the connection link interacting with a rotation of the link element so that, when the cover is opened when the manual paper feed tray is positioned in the opened position, the open angle of the manual paper feed tray is maintained so as to be equal to or less than 90 degrees with respect to a vertical direction.

2. The cover opening and closing unit of claim 1, wherein the link element comprises a plurality of main links that are rotatably connected to one another and a plurality of springs that are respectively installed in connection portions between the plurality of main links to apply an elastic force in a direction in which the plurality of main links are unfolded from each other.

3. The cover opening and closing unit of claim 2, wherein a cover-side main link among the plurality of main links is connected to the cover and comprises a protrusion to which the first end of the connection link is rotatably connected.

4. The cover opening and closing unit of claim 3, wherein a guide protrusion installed at the second end of the connection link is inserted into the guide rail to slide along the guide rail.

5. The cover opening and closing unit of claim 1, wherein the open angle is 90 degrees or less with respect to the vertical direction regardless of whether the cover is opened or closed.

6. The cover opening and closing unit of claim 5, wherein the cover is opened at an angle of 50 degrees or less with respect to the main body.

7. A cover opening and closing unit comprising:

a cover installed to be opened and closed from a main body;

a manual paper feed tray on which sheets of paper are loaded, installed on the cover to rotate to a closed position and an opened position, and comprising a guide rail;

a link element connecting the cover to the main body and comprising a plurality of links that rotate with respect to each other in a direction in which the plurality of links are unfolded from each other or folded with each other when the cover is opened or closed; and a connection link having a first end that is rotatably connected to one of the plurality of links and a second end that is slidably connected to the guide rail, the connection link interacting with the rotation of the plurality of links so that, when the cover is opened when the manual paper feed tray is positioned in the opened position, an open angle of the manual paper feed tray with respect to a vertical direction is maintained so as to be equal to or less than 90 degrees.

8. The cover opening and closing unit of claim 7, further comprising:

a plurality of springs that apply an elastic force in a direction in which the plurality of links are unfolded from each other.

9. The cover opening and closing unit of claim 7, wherein, when the cover is opened when the manual paper feed tray is positioned in the opened position, the manual paper feed tray rotates toward the cover.

10. The cover opening and closing unit of claim 7, wherein one of the plurality of links comprises a connection part to which the first end of the connection link is rotatably connected, wherein, when the cover is opened, the plurality of links are unfolded from each other and the connection part is moved away from the cover.

11. An image forming apparatus comprising:

at least one developing unit for developing an electrostatic latent image;

a fixing unit for fixing a toner image developed by the developing unit on paper; and the cover opening and closing unit according to claim 1.

12. The image forming apparatus of claim 11, wherein the link element comprises a plurality of main links that are rotatably connected to one another and a plurality of springs that are respectively installed in connection portions between the plurality of main links and apply an elastic force in a direction in which the plurality of main links are unfolded from each other.

13. The image forming apparatus of claim 12, wherein a cover-side main link among the plurality of main links is connected to the cover and comprises a protrusion to which the first end of the connection link is rotatably connected.

14. The image forming apparatus of claim 13, wherein a guide protrusion installed at the second end of the connection link is inserted into the guide rail to slide along the guide rail.

15. The image forming apparatus of claim 11, wherein the open angle is 90 degrees or less with respect to the vertical direction regardless of whether the cover is opened or closed.

16. The image forming apparatus of claim 15, wherein the cover is opened at an angle of 50 degrees or less with respect to the main body.

* * * * *